US010274887B2

(12) United States Patent
Makita et al.

(10) Patent No.: US 10,274,887 B2
(45) Date of Patent: Apr. 30, 2019

(54) BINDING APPARATUS AND IMAGE FORMING SYSTEM

(71) Applicant: FUJI XEROX CO., LTD., Tokyo (JP)

(72) Inventors: Takuya Makita, Kanagawa (JP); Hiroaki Awano, Kanagawa (JP); Kojiro Tsutsumi, Kanagawa (JP); Katsumi Harada, Kanagawa (JP); Toshiyasu Yukawa, Kanagawa (JP); Takashi Ogino, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/699,000

(22) Filed: Sep. 8, 2017

(65) Prior Publication Data

US 2018/0275586 A1 Sep. 27, 2018

(30) Foreign Application Priority Data

Mar. 22, 2017 (JP) ..... 2017-056658

(51) Int. Cl.

| | |
|---|---|
| ***B31F 5/02*** | (2006.01) |
| ***G03G 15/00*** | (2006.01) |
| ***B42B 5/08*** | (2006.01) |
| ***B42B 4/00*** | (2006.01) |
| ***B42B 5/00*** | (2006.01) |
| ***B42C 1/12*** | (2006.01) |

(52) U.S. Cl.

CPC ..... *G03G 15/6544* (2013.01); *B31F 5/02* (2013.01); *B42B 4/00* (2013.01); *B42B 5/00* (2013.01); *B42B 5/08* (2013.01); *B42C 1/12* (2013.01); *B65H 2301/43828* (2013.01); *B65H 2301/51616* (2013.01); *B65H 2801/27* (2013.01); *G03G 2215/00848* (2013.01)

(58) Field of Classification Search

CPC ..... B31F 5/00; B31F 5/02; B31F 2201/0712; B42F 3/006; B65H 37/04; B65H 2801/24; B65H 2801/27; B65H 2301/43828; B65H 2301/51616; G03G 15/6544; G03G 2215/00852; G03G 2215/00848

USPC ..... 270/58.07, 58.08

See application file for complete search history.

(56) References Cited

U.S. PATENT DOCUMENTS 6,997,453 B2 * 2/2006 Matsuda ..... B29C 45/26 271/121

8,333,372 B2 * 12/2012 Awaya ..... B65H 37/04 270/58.07

(Continued)

FOREIGN PATENT DOCUMENTS

JP 2010-274623 A 12/2010

*Primary Examiner* — Leslie A Nicholson, III

(74) *Attorney, Agent, or Firm* — Sughrue Mion, PLLC

(57) ABSTRACT

A binding apparatus includes: a first pressing member that presses a recording-medium stack from one side of the recording-medium stack; a second pressing member that faces the first pressing member and presses the recording-medium stack from the other side of the recording-medium stack; and a suppressing part provided in at least one of the first pressing member and the second pressing member, the suppressing part suppressing damage to recording media that may be caused when a recording-medium stack including a smaller number of sheets than the maximum number of sheets that can be bound is bound with the first pressing member and the second pressing member.

11 Claims, 9 Drawing Sheets

(56) References Cited

U.S. PATENT DOCUMENTS

| | | | | |
|---|---|---|---|---|
| 8,899,568 | B2 * | 12/2014 | Matsushita | B31F 5/02 270/58.07 |
| 9,764,920 | B2 * | 9/2017 | Abe | B42B 5/00 |
| 2014/0353900 | A1 * | 12/2014 | Abe | B42B 5/00 270/58.08 |
| 2017/0174465 | A1 * | 6/2017 | Morinaga | B31F 5/02 |
| 2017/0282482 | A1 * | 10/2017 | Awano | B31F 5/02 |
| 2017/0283207 | A1 * | 10/2017 | Makita | B65H 37/04 |

* cited by examiner

BINDING APPARATUS AND IMAGE FORMING SYSTEM

CROSS-REFERENCE TO RELATED APPLICATIONS

This application is based on and claims priority under 35 USC 119 from Japanese Patent Application No. 2017-056658 filed Mar. 22, 2017.

BACKGROUND

Technical Field

The present invention relates to a binding apparatus and an image forming system.

SUMMARY

According to an aspect, there is provided a binding apparatus including: a first pressing member that presses a recording-medium stack from one side of the recording-medium stack; a second pressing member that faces the first pressing member and presses the recording-medium stack from the other side of the recording-medium stack; and a suppressing part provided in at least one of the first pressing member and the second pressing member, the suppressing part suppressing damage to recording media that may be caused when a recording-medium stack including a smaller number of sheets than the maximum number of sheets that can be bound is bound with the first pressing member and the second pressing member.

BRIEF DESCRIPTION OF THE DRAWINGS

Exemplary embodiments of the present invention will be described in detail based on the following figures, wherein.

DETAILED DESCRIPTION

First Exemplary Embodiment

Referring to the attached drawings, exemplary embodiments of the present invention will be described in detail below.

Figure 1:
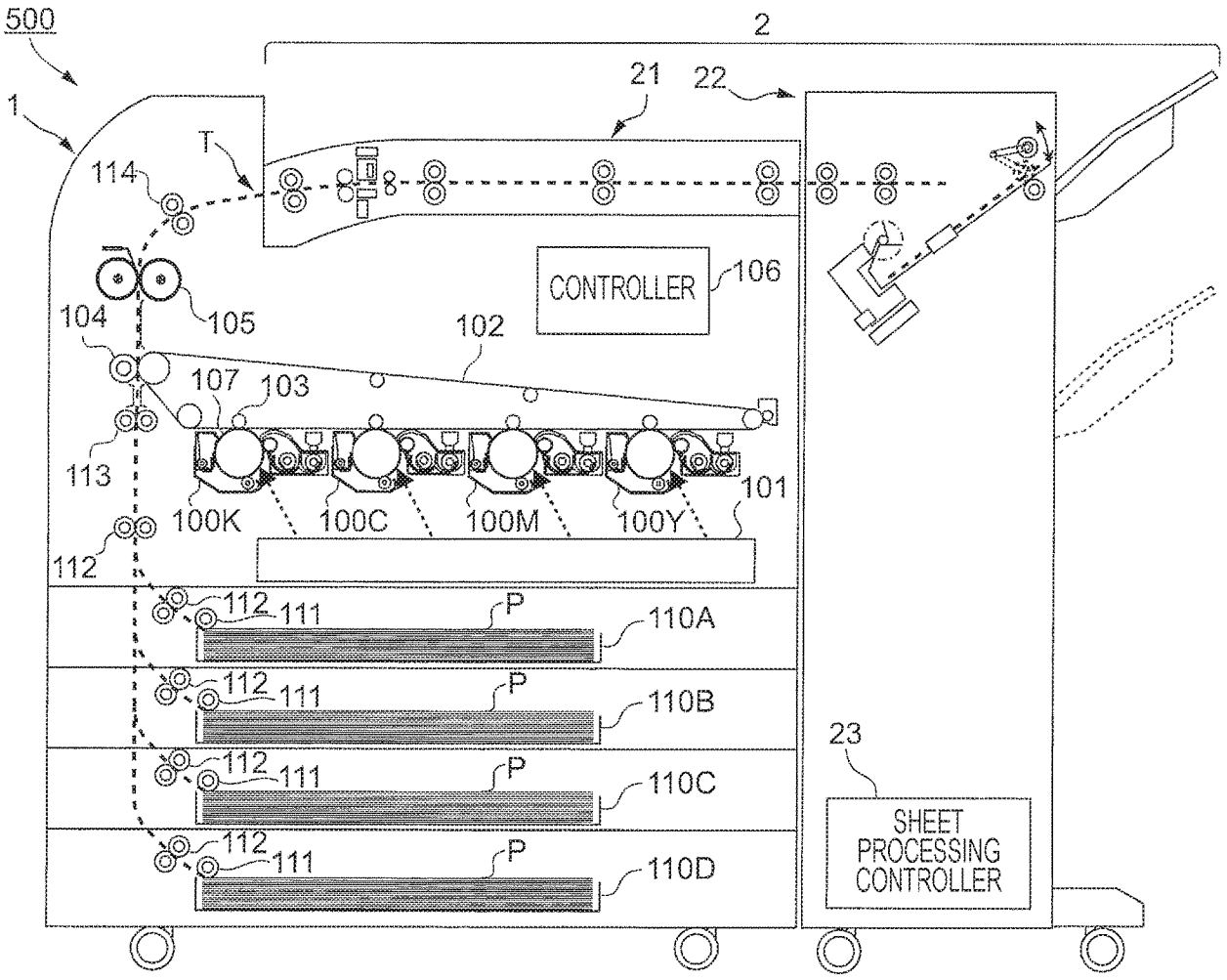
FIG. 1 shows the configuration of an image forming system.

FIG. 1 shows the configuration of an image forming system 500 according to this exemplary embodiment.

The image forming system 500 shown in FIG. 1 includes an image forming apparatus 1, such as a printer or a copier, that forms a color image on a sheet P, serving as an example of a recording medium, and a post-processing apparatus 2 that performs post-processing, such as binding, on the sheet P on which an image has been formed by the image forming apparatus 1.

The image forming apparatus 1, serving as an example of an image forming part, includes four image-forming units 100Y, 100M, 100C, and 100K (also collectively referred to as "image-forming units 100") that form images according to the corresponding color image data.

The image forming apparatus 1 also includes a laser exposure device 101 that irradiates photoconductor drums 107 of the image-forming units 100 with light. The image forming apparatus 1 also includes an intermediate transfer belt 102, to which color toner images formed in the image-forming units 100 are transferred in an overlapping manner.

The image forming apparatus 1 also includes first transfer rollers 103 that sequentially transfer the color toner images formed in the image-forming units 100 to the intermediate transfer belt 102 (first transfer), second transfer rollers 104 that transfers, all at once, the color toner images transferred to the intermediate transfer belt 102 to a sheet P (second transfer), and a fixing device 105 that fixes the second-transferred color toner images to the sheet P. The image forming apparatus 1 also includes a controller 106 that includes a program-controlled central processing unit (CPU) and controls the operation of the image forming apparatus 1.

In the image-forming units 100 of the image forming apparatus 1, color toner images are formed through the processes of charging the photoconductor drums 107, forming electrostatic latent images on the photoconductor drums 107 by scanning the photoconductor drums 107 with light from the laser exposure device 101, developing the thus-formed electrostatic latent images with color toners, and the like.

The color toner images formed on the image-forming units 100 are sequentially and electrostatically transferred to the intermediate transfer belt 102 by the first transfer rollers 103 (first transfer). Then, the color toner images are transported to the second transfer rollers 104 as the intermediate transfer belt 102 revolves.

In the image forming apparatus 1, multiple sheets P that differ in size and type are stored in sheet containers 110A to 110D.

When an image is to be formed on a sheet P, for example, the sheet P is picked up from the sheet container 110A by the pick-up roller 111 and is transported to registration rollers 113 by transport rollers 112.

Then, the registration rollers 113 feed the sheet P at the same time when the color toner images on the intermediate transfer belt 102 are transported to the second transfer rollers 104.

Then, the color toner images are electrostatically transferred (second-transferred), all at once, to the sheet P by the effect of a transfer electric field formed by the second transfer rollers 104.

Thereafter, the sheet P to which the color toner images have been second-transferred is separated from the intermediate transfer belt 102 and is transported to the fixing device 105. In the fixing device 105, the color toner images are fixed to the sheet P through fixing processing, in which heat and pressure are applied. Thus, the image is formed.

The sheet P on which the image has been formed is discharged from a sheet discharge part T of the image forming apparatus 1 by transport rollers 114 and is then fed to the post-processing apparatus 2.

The post-processing apparatus 2, serving as an example of a binding apparatus, is located downstream of the sheet discharge part T of the image forming apparatus 1 and performs post-processing, such as punching and binding, on the sheet P on which an image has been formed.

Figure 2:
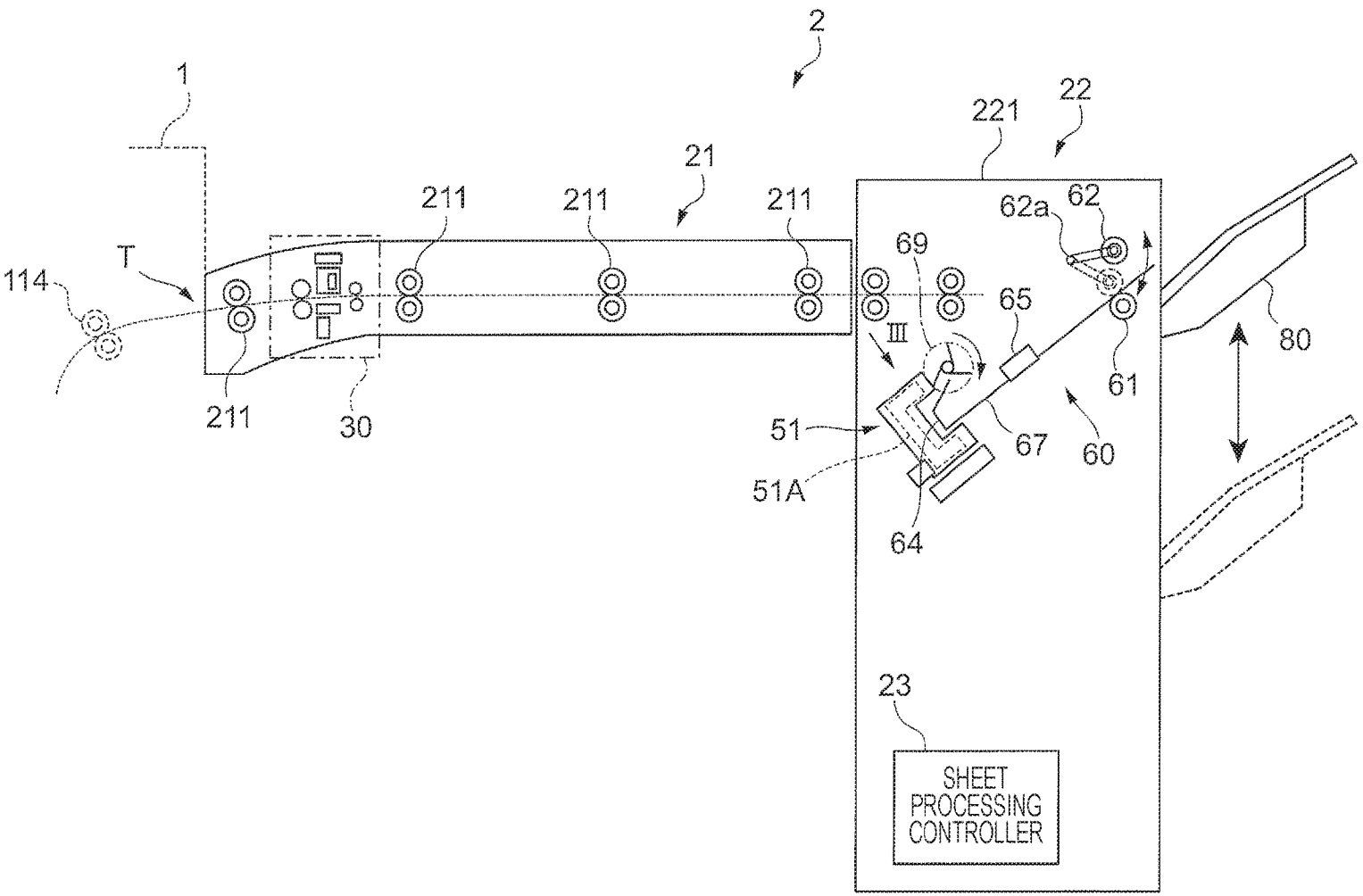
FIG. 2 shows the configuration of a post-processing apparatus.

FIG. 2 shows the configuration of the post-processing apparatus 2.

The post-processing apparatus 2 includes a transport unit 21 connected to the sheet discharge part T of the image forming apparatus 1, and a finisher unit 22 that performs predetermined processing on the sheet P transported by the transport unit 21.

The post-processing apparatus 2 also includes a sheet processing controller 23 that controls the respective mechanisms in the post-processing apparatus 2. The sheet processing controller 23 includes a program-controlled CPU. The sheet processing controller 23 is connected to the controller 106 (see FIG. 1) via a signal line (not shown) and transmits and receives control signals and other signals to and from the controller 106.

The transport unit 21 of the post-processing apparatus 2 includes a punching functional part 30 that creates (punches) two, four, or other number of holes, and transport rollers 211 that transport the sheet P, on which the image has been formed in the image forming apparatus 1, to the finisher unit 22.

The finisher unit 22 includes a finisher unit body 221, a sheet collecting part 60 that collects a necessary number of sheets P to form a sheet stack, and a binding unit 51 that binds an end of the sheet stack formed in the sheet collecting part 60 (end binding).

The finisher unit 22 includes a rotatable transport roller 61 that is used to transport the sheet stack formed in the sheet collecting part 60. The finisher unit 22 also includes a roller 62 that can pivot about a rotation axis 62*a* and can move between a position where it is retracted from the transport roller 61 and a position where it presses the transport roller 61.

The finisher unit 22 also includes a stacker 80, on which bound sheet stacks transported from the transport roller 61 and the movable roller 62 are stacked. The stacker 80 moves up or down according to the amount of the bound sheet stacks it supports.

When the post-processing apparatus 2 performs processing, first, a sheet P is transported from the image forming apparatus 1 into the transport unit 21 of the post-processing apparatus 2.

In the transport unit 21, the sheet P is punched by the punching functional part 30 and is then sent to the finisher unit 22 by the transport rollers 211.

When there is no punching instruction, the sheet P is sent straight to the finisher unit 22 without being punched by the punching functional part 30.

The sheet P sent to the finisher unit 22 is transported to the sheet collecting part 60. More specifically, the sheet P is transported to a position above the sheet collecting part 60 and then drops onto the sheet collecting part 60. The sheet P is supported from below by a support plate 67 provided in the sheet collecting part 60. Then, the sheet P slides over the support plate 67 due to the inclination thereof and the operation of a rotating paddle 69.

The sheet P then comes into contact with an end guide 64 attached to an end of the support plate 67, and thus, in this exemplary embodiment, the movement of the sheet P stops.

This operation is performed each time a sheet P is transported from the upstream side, and a sheet stack (a recording-medium stack) is formed on the sheet collecting part 60 with the trailing ends of the sheets P being aligned.

Furthermore, in this exemplary embodiment, aligning members 65 that are movable in the sheet-stack width direction (i.e., a direction perpendicular to the plane of the sheet of FIG. 2) are provided to adjust the widthwise position of the sheet stack.

There are two aligning members 65; one is on one side of the sheet stack, and the other is on the other side of the sheet stack in the width direction.

In this exemplary embodiment, each time a sheet P is fed to a position above the support plate 67, the widthwise ends (i.e., the sides) of the sheets P are pushed by the aligning members 65 such that the widthwise positions of the sheets P (sheet stack) are adjusted.

Once a predetermined number of sheets P have been stacked on the support plate 67, and a sheet stack has been formed on the support plate 67, the binding unit 51 binds an end of the sheet stack.

The binding unit 51 has a pressing member pair 81 (described below) that presses the sheet stack. The pressing member pair includes an upper and a lower pressing member (described below). In this exemplary embodiment, an advancing/retracting mechanism 51A that advances or retracts one of the upper and lower pressing members toward or from the other is provided.

In this exemplary embodiment, the upper and lower pressing members are pressed against the sheet stack from both sides of the sheet stack to join, by pressure, the sheets constituting the sheet stack and thus binds the sheet stack. In other words, in this exemplary embodiment, the sheet stack is bound without staples or other metal fasteners.

In this exemplary embodiment, once the sheet stack is bound, the movable roller 62 moves toward the transport roller 61, and the sheet stack is nipped between the movable roller 62 and the transport roller 61. Then, the transport roller 61 and the movable roller 62 are rotated to transport the bound sheet stack to the stacker 80.

Figure 3:
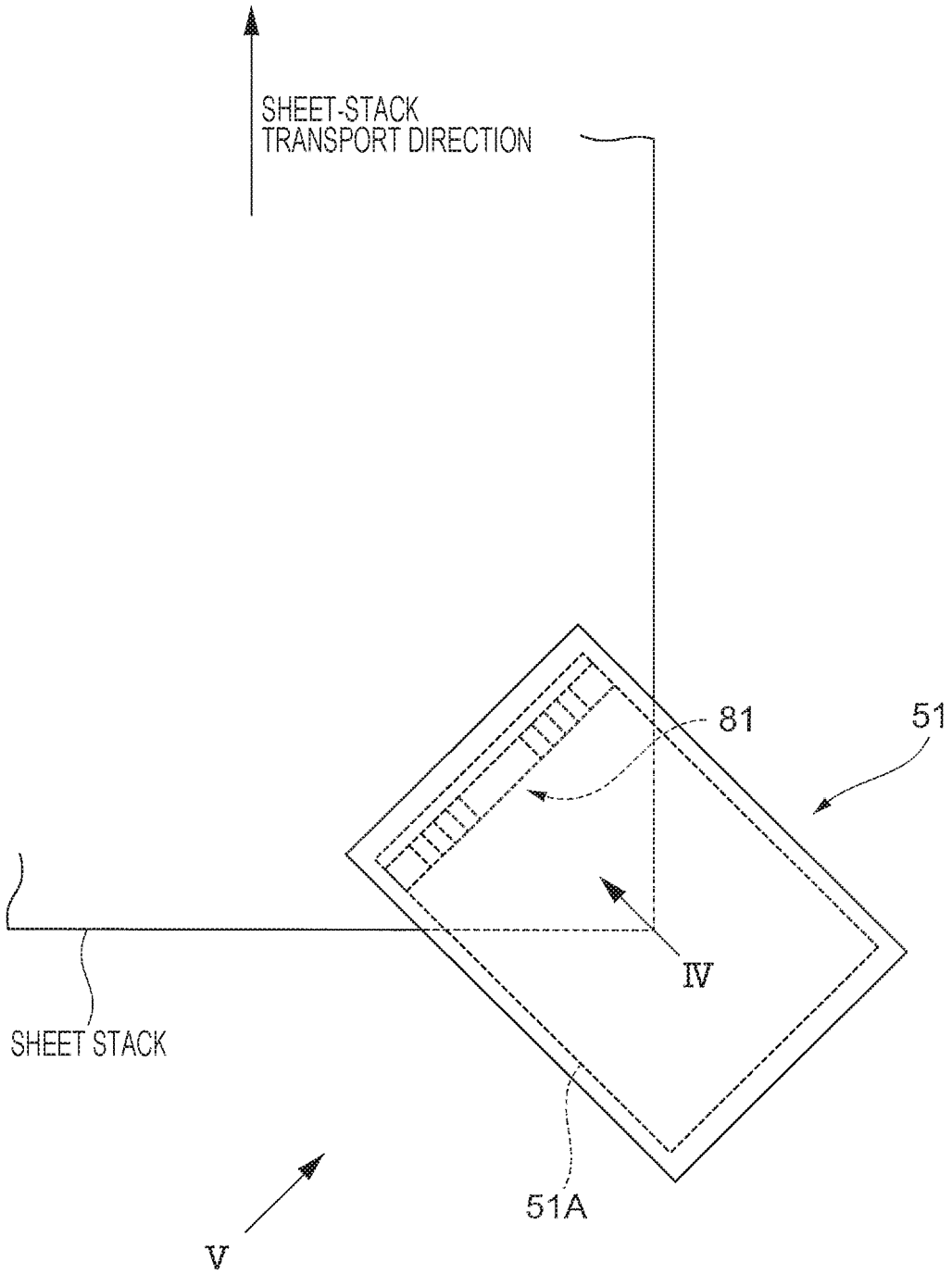
FIG. 3 shows a binding unit, as viewed in an arrow III direction in FIG. 2.

FIG. 3 shows the binding unit 51, as viewed in an arrow III direction in FIG. 2.

In this exemplary embodiment, as shown in FIG. 3, the binding unit 51 is disposed at an angle to the sheet-stack transport direction. In this exemplary embodiment, the binding unit 51 performs binding on a corner of the sheet stack.

The binding unit 51 in this exemplary embodiment includes the pressing member pair 81.

Figure 4:
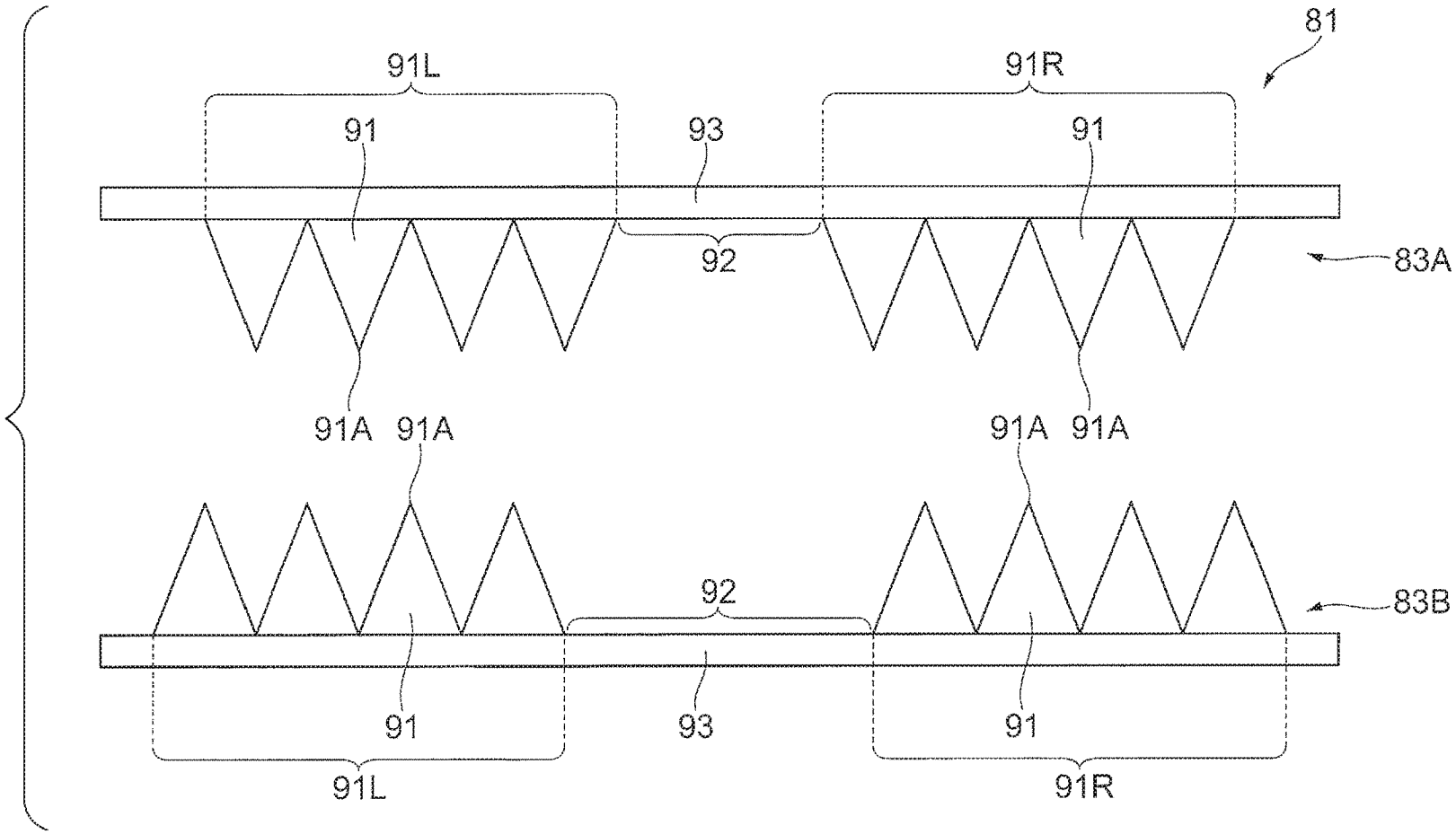
FIG. 4 shows a pressing member pair, as viewed in an arrow IV direction in FIG. 3.

FIG. 4 shows the pressing member pair 81, as viewed in the arrow IV direction in FIG. 3.

As shown in FIG. 4, the pressing member pair 81 includes an upper pressing member 83A and a lower pressing member 83B.

As shown in FIG. 4, the upper pressing member 83A and the lower pressing member 83B each include a left projection group 91L and a right projection group 91R. The left projection group 91L of the upper pressing member 83A is provided at a position facing the left projection group 91L of the lower pressing member 83B. Similarly, the right projection group 91R of the upper pressing member 83A is provided at a position facing the right projection group 91R of the lower pressing member 83B.

Each of the left projection group 91L and the right projection group 91R of the upper pressing member 83A and the lower pressing member 83B have multiple projections 91 that are arranged side-by-side. More specifically, each of the left projection group 91L and the right projection group 91R of the upper pressing member 83A and the lower pressing member 83B has four projections 91 that are arranged side-by-side.

The projections 91 are formed so as to extend in one direction (i.e., a direction perpendicular to the plane of the sheet of FIG. 4). The projections 91 have a triangular section.

The projections 91 are formed so as to extend in one direction (i.e., a direction perpendicular to the plane of the sheet of FIG. 4) and are arranged side-by-side in a direction perpendicular to the aforementioned direction (i.e., the left-right direction in FIG. 4).

In this exemplary embodiment, the upper pressing member 83A and the lower pressing member 83B each have a rectangular parallelepiped-shaped base part 93, and the projections 91 project from the surface of the base part 93. The projections 91 have the apexes 91A at ends in the projecting direction (i.e., the top-bottom direction in FIG. 4).

In this exemplary embodiment, the upper pressing member 83A and the lower pressing member 83B each have a void part 92 where the projections 91 are not provided. In other words, the projections 91 are not provided in the void parts 92.

The void parts 92 (i.e., the void part 92 in the upper pressing member 83A and the void part 92 in the lower pressing member 83B), serving as an example of suppressing parts, are provided between the left projection groups 91L and the right projection groups 91R. In this exemplary embodiment, the void part 92 in the upper pressing member 83A and the void part 92 in the lower pressing member 83B face each other.

The projections 91 have a suitable size for binding a sheet stack according to the thickness of the sheet stack.

In this exemplary embodiment, the projections 91 formed on the pressing member pair 81 are large. Hence, when these projections 91 are pressed against a sheet stack, the deformation of the sheet stack is large.

Therefore, in this exemplary embodiment, a sheet stack including a large number of sheets can be bound by using the pressing member pair 81. More specifically, in this exemplary embodiment, a sheet stack including, for example, up to ten sheets can be bound by using the pressing member pair 81. In this exemplary embodiment, the projections 91 has a size suitable for binding a sheet stack including ten sheets.

The maximum number of sheets is a value that is identified, in the specifications given in a product catalog or other materials, as the maximum number of sheets in a sheet stack that can be bound. In other words, the maximum number of sheets is, for example, the upper limit of the number of sheets in a sheet stack that can be appropriately bound by using the pressing member pair 81.

Figure 5A:
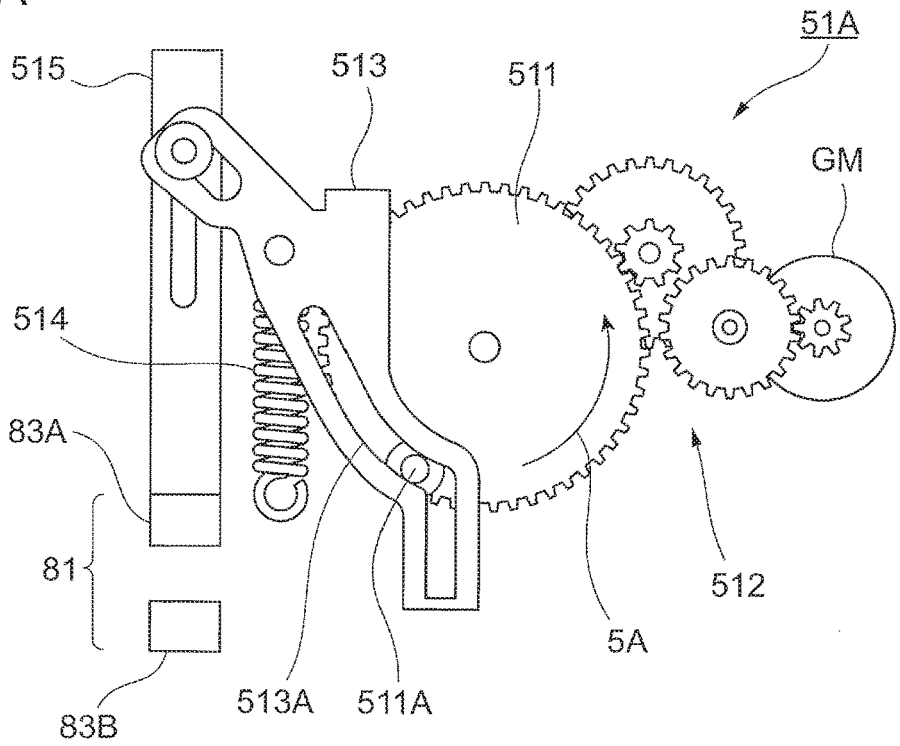
FIGS. 5A and 5B show an advancing/retracting mechanism, as viewed in an arrow V direction in FIG. 3.
Figure 5B:
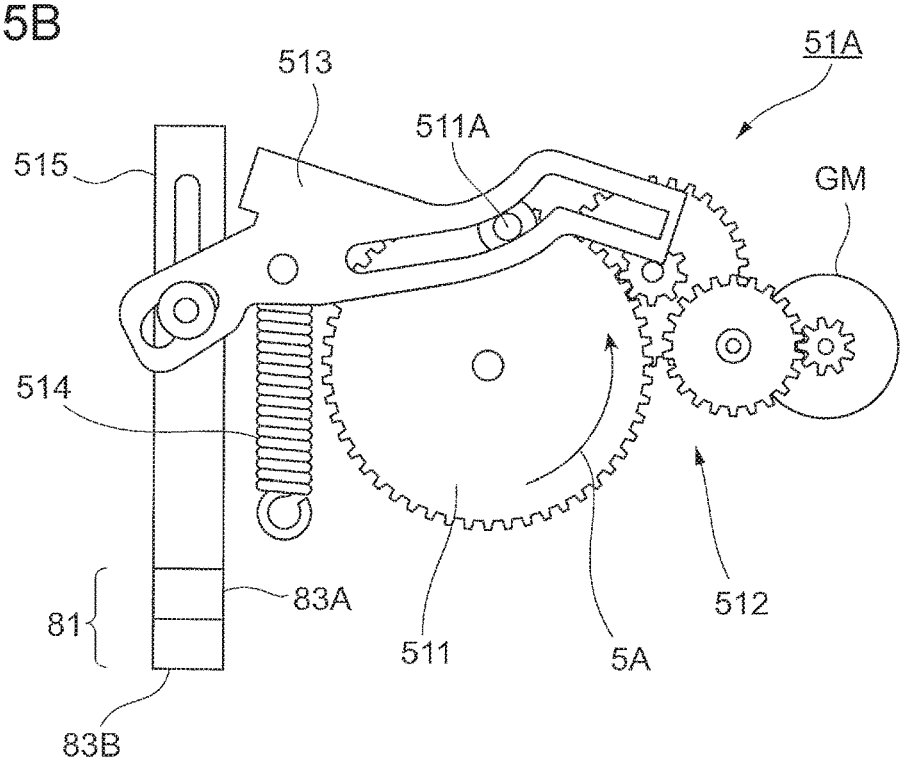

FIGS. 5A and 5B show the advancing/retracting mechanism 51A, as viewed in an arrow V direction in FIG. 3.

As shown in FIG. 5A, the advancing/retracting mechanism 51A according to this exemplary embodiment includes a rotary gear 511. The advancing/retracting mechanism 51A also includes a gear motor GM for rotating the rotary gear 511, and transmission gears 512 for transmitting the rotational driving force from the gear motor GM to the rotary gear 511. The rotary gear 511 has a projection 511A on a side surface thereof.

The advancing/retracting mechanism 51A also includes a crank member 513 that pivots. The crank member 513 has an elongated hole 513A in which the projection 511A of the rotary gear 511 is positioned.

The advancing/retracting mechanism 51A also includes a spring 514 for urging the crank member 513 downward, and an advancing/retracting member 515 that is attached to the left end of the crank member 513 (in FIGS. 5A and 5B) and that moves up and down. In this exemplary embodiment, the upper pressing member 83A is attached to the lower end of the advancing/retracting member 515.

FIG. 5A shows a state in which the advancing/retracting member 515 has moved upward, and the upper pressing member 83A has retracted from the lower pressing member 83B.

When binding is performed, the gear motor GM is driven, rotating the rotary gear 511 in an arrow 5A direction in FIG. 5A. As a result, the rotary gear 511 and other members are in the state shown in FIG. 5B.

In the state shown in FIG. 5B, the projection 511A of the rotary gear 511 is positioned on the upper side, and the right end (in FIG. 5B) of the crank member 513 is lifted upward.

Furthermore, the crank member 513 is pulled downward by the spring 514, and the advancing/retracting member 515 is moved downward. As a result, the upper pressing member 83A is pressed against the sheet stack (not shown in FIGS. 5A and 5B). In this case, the sheet stack is nipped between the upper pressing member 83A and the lower pressing member 83B, and thus, the sheets constituting the sheet stack are joined together by pressure.

Figure 6A:
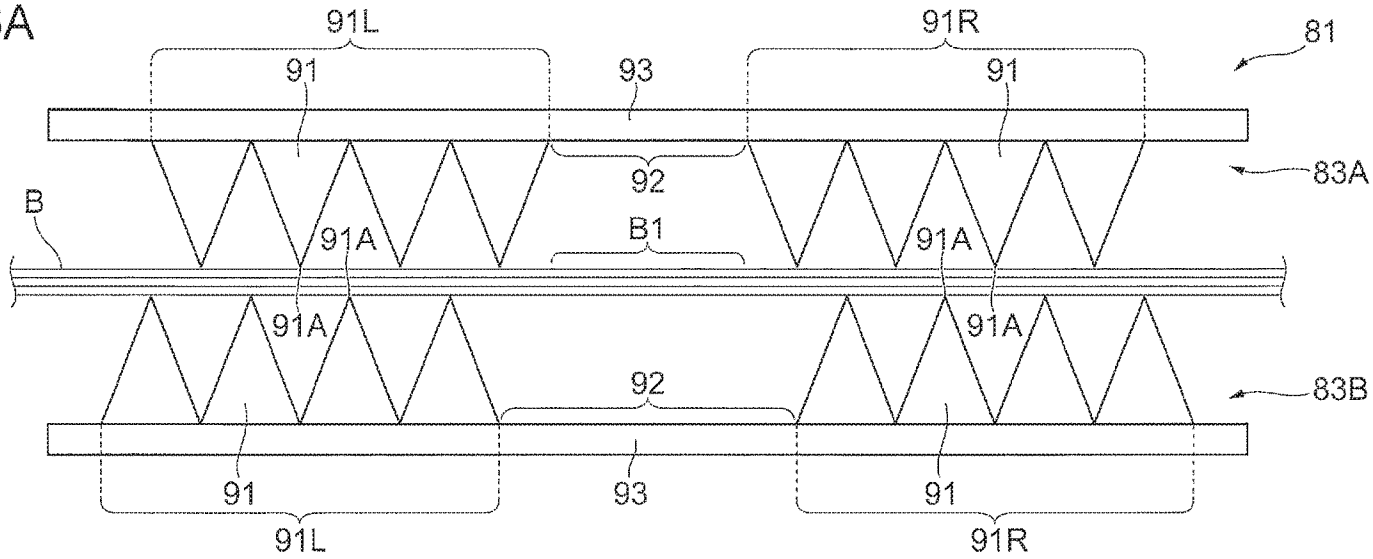
FIGS. 6A and 6B show the movement of the pressing member pair during binding.
Figure 6B:
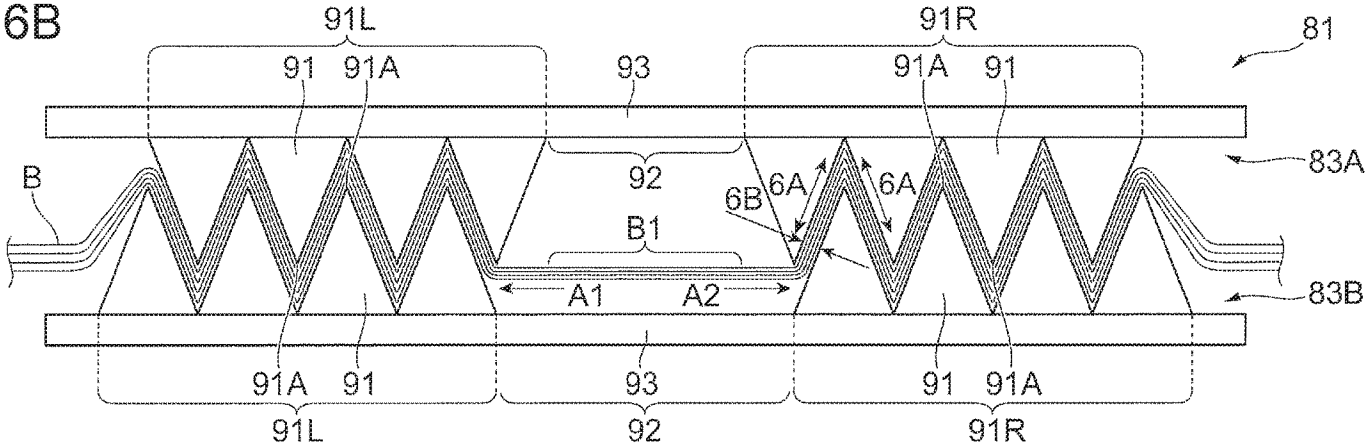

FIGS. 6A and 6B show the movement of the pressing member pair 81 during binding.

In this exemplary embodiment, first, a sheet stack is formed on the support plate 67 (see FIG. 2). Once the sheet stack is formed, the sheet stack is located between the upper pressing member 83A (see FIG. 4) and the lower pressing member 83B.

During binding, from the state shown in FIG. 4 (the sheet stack is not shown in FIG. 4), the advancing/retracting mechanism 51A (see FIGS. 5A and 5B) moves the upper pressing member 83A down toward the lower pressing member 83B. As a result of the upper pressing member 83A being moved downward, as shown in FIG. 6A, the apexes 91A of the projections 91 of the upper pressing member 83A and the apexes 91A of the projections 91 of the lower pressing member 83B are pressed against a sheet stack B.

At this time, the projections 91 are not in contact with an opposing part B1 of the sheet stack B that faces the void parts 92 in the upper pressing member 83A and the lower pressing member 83B.

Then, as shown in FIG. 6B, the upper pressing member 83A moves further downward. When the upper pressing member 83A moves downward, the projections 91 of the upper pressing member 83A enter the spaces between the adjacent projections 91 of the lower pressing member 83B while pressing the sheet stack B. The projections 91 of the lower pressing member 83B enter the spaces between the adjacent projections 91 of the upper pressing member 83A while pressing the sheet stack B.

In this exemplary embodiment, when the upper pressing member 83A retracts, the binding of the sheet stack B is completed.

In this exemplary embodiment, a portion of the sheet stack B is elongated in the direction indicated by reference sign 6A (i.e., the direction perpendicular to the thickness direction of the sheet stack B) during binding. As a result, in each sheet constituting the sheet stack B, the fibers forming the sheet are elongated, and the gaps between the fibers are expanded. Furthermore, during binding, a pressure in the direction indicated by reference sign 6B (i.e., the thickness direction of the sheet stack B) is applied to the sheet stack B. As a result, the fibers of a first sheet constituting the sheet stack B enter the expanded spaces between the fibers of a second sheet next to the first sheet.

Thereafter, in this exemplary embodiment, the pressure applied to the sheet stack B is removed. This allows the fibers constituting the first sheet to be entangled with the fibers of the second sheet, and thus, the sheets constituting the sheet stack B are joined together.

Figure 7:
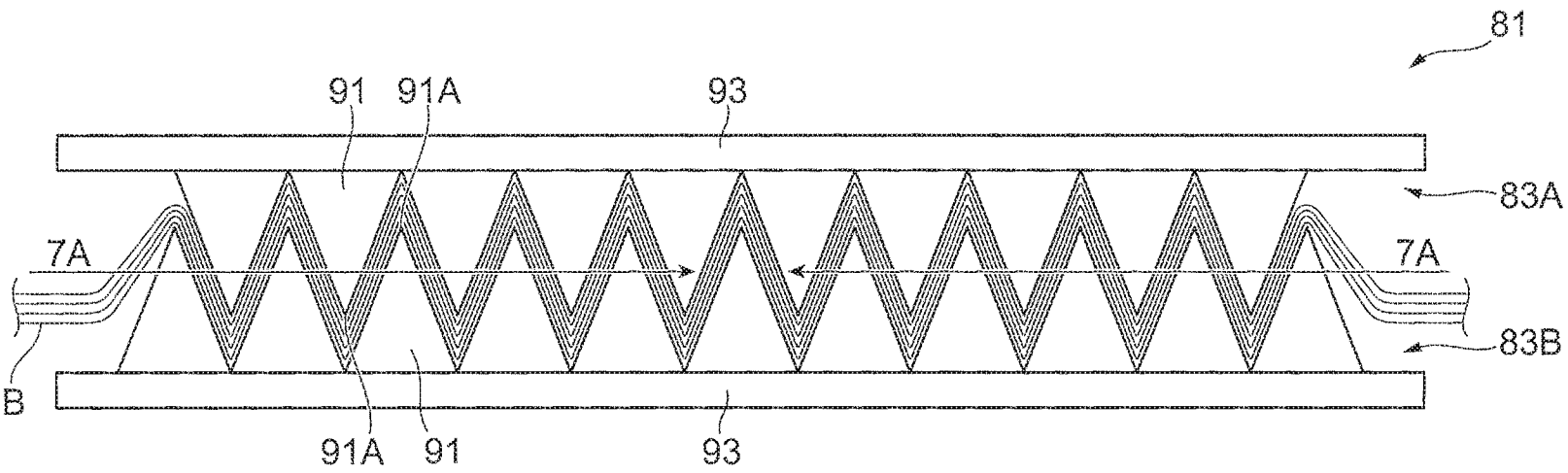
FIG. 7 shows binding of a sheet stack using a pressing member pair according to a comparative example.

FIG. 7 shows binding of a sheet stack using a pressing member pair 81 in a comparative example. The components common to those in the first exemplary embodiment will be denoted by the same reference signs.

In the configuration shown in FIG. 7, neither of the upper pressing member 83A and the lower pressing member 83B have the void part 92. More specifically, the upper pressing member 83A and the lower pressing member 83B have the projections 91 that are continuously arranged side-by-side from one end to the other end in the left-right direction of the pressing member pair 81.

According to the comparative example shown in FIG. 7, when the projections 91 on the upper pressing member 83A and the lower pressing member 83B are pressed against the sheet stack B, the sheet stack B is tucked in toward the middle part in the longitudinal direction of the pressing member pair 81 (the left-right direction in FIG. 7), as shown by reference sign 7A.

In this comparative example, the projections 91 are pressed against the sheet stack B over the entirety of the pressing member pair 81 in the longitudinal direction. As a result, the sheet stack B tends to be elongated (the amount of elongation of the sheet stack B increases).

In this comparative example, particularly when a sheet stack B including a small number of sheets is to be bound, the sheets tend to be elongated.

In the comparative example, when, for example, a sheet stack B including the maximum number of sheets (for example, ten) that can be bound by using the pressing member pair 81 is to be bound, because the sheet stack B is thick, the deformation of the sheet stack B is inhibited, and the elongation of the sheet stack B decreases.

However, when a sheet stack B including a smaller number of sheets (for example, four in FIG. 7) than the maximum number of sheets is to be bound, the sheet stack B tends to deform and deeply enter the spaces between the adjacent projections 91. In this case, the elongation of the sheet stack B is large. Moreover, because the apexes 91A of the projections 91 come into contact with the sheet stack B, the sheets constituting the sheet stack B tend to be damaged, lowering the sheet binding force.

In contrast, as in this exemplary embodiment, in the configuration in which the void parts 92 are provided in the pressing member pair 81 (see FIG. 6B), the projections 91 are not pressed against the opposing part B1 of the sheet stack B that faces the void parts 92. Hence, in the opposing part B1, the elongation of the sheets caused as a result of the projections 91 being pressed against is suppressed.

In this case, the elongation of the overall sheet stack B decreases by an amount corresponding to the amount by which the elongation of the sheets at the opposing part B1 is suppressed. In other words, the tension of a portion of the sheet stack B to which the projections 91 are pressed against (i.e., the tension acting in the sheet stack B, in a direction perpendicular to the thickness direction of the sheet stack B) decreases by an amount corresponding to the amount by which the elongation at the opposing part B1 is suppressed. As a result, even when binding is performed on a sheet stack B including a small number of sheets, damage to the sheets is less likely to occur, and the sheet binding force is less likely to decrease.

In this exemplary embodiment, in each of the upper pressing member 83A and the lower pressing member 83B, the void part 92 is provided between the left projection group 91L and the right projection group 91R.

This makes it possible to suppress, with a smaller number of void parts 92, damage to the sheets due to the projection groups.

For example, damage to the sheets due to the left and right projection groups can be suppressed also by providing the void parts 92 corresponding to the left projection group 91L and the right projection group 91R (see FIG. 4). More specifically, for example, by providing the void part 92 to the left or to the right of each of the left and right projection groups, it is possible to reduce the elongation of the sheets due to the left and right projection groups and to suppress the damage to the sheets. However, in this case, the same number of the void parts 92 as the projection groups need to be provided, which increases the size of the pressing members.

In contrast, as in this exemplary embodiment, in the configuration in which the void part 92 is provided between the left and right projection groups, the elongation of the sheets due to the left and right projection groups can be reduced by a single void part 92. In this case, the damage to the sheets due to the left and right projection groups can be suppressed without increasing the size of the pressing members.

Second Exemplary Embodiment

Figure 8A:
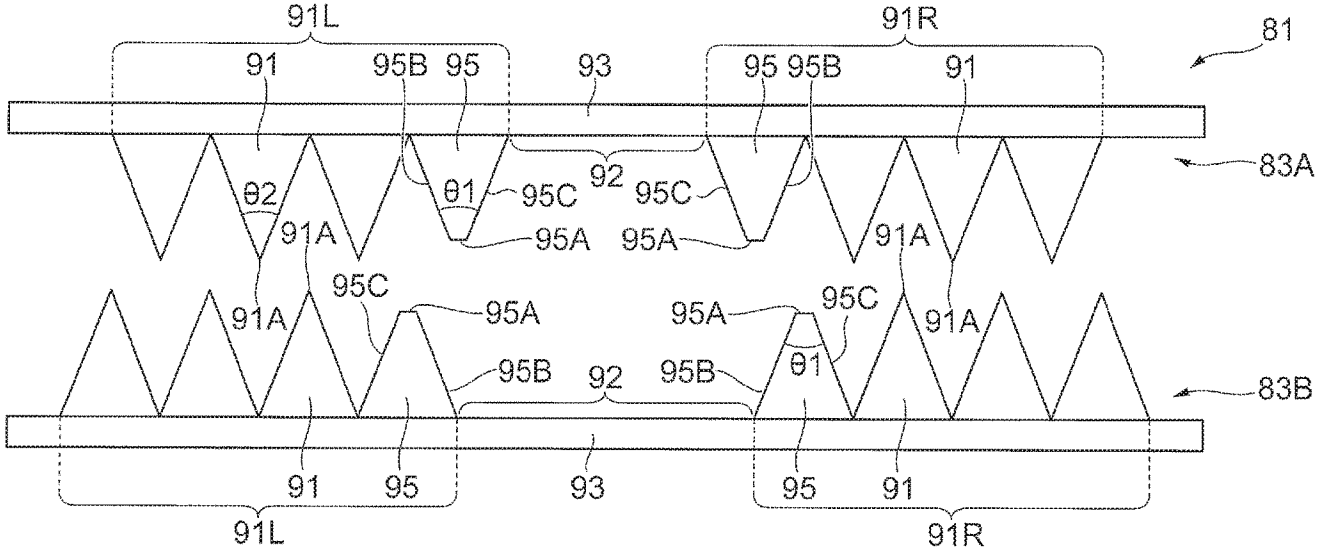
FIG. 8A shows a pressing member pair according to a second exemplary embodiment.
Figure 8B:
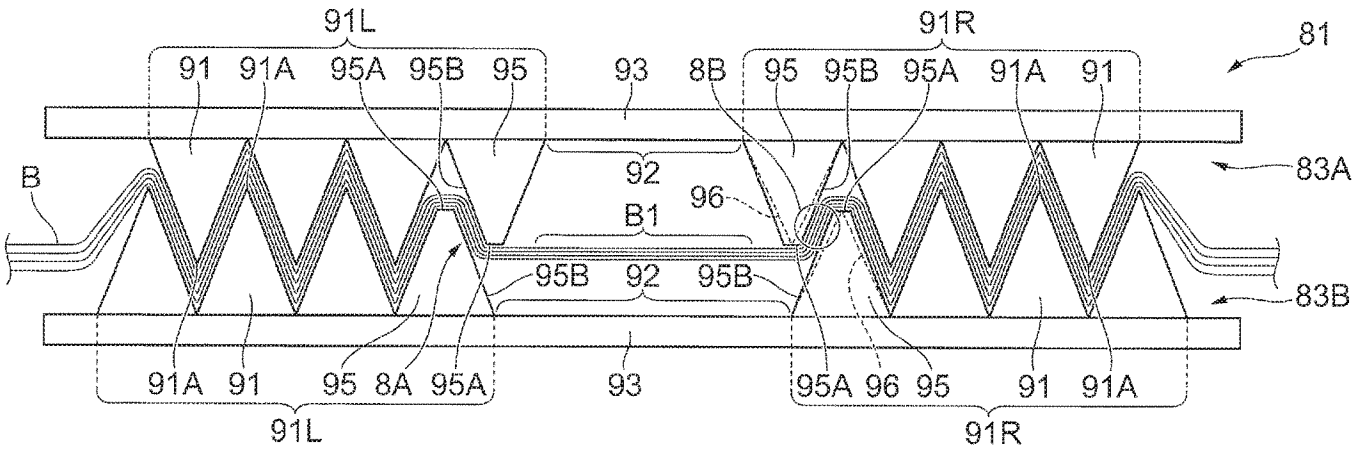
FIG. 8B shows the movement of the pressing member pair during binding.

FIG. 8A shows the pressing member pair 81 according to a second exemplary embodiment, and FIG. 8B shows the movement of the pressing member pair 81 during binding. The components common to those in the first exemplary embodiment will be denoted by the same reference signs.

As shown in FIG. 8A, and as described above, the pressing member pair 81 includes the upper pressing member 83A and the lower pressing member 83B.

The upper pressing member 83A and the lower pressing member 83B each have the left projection group 91L, the right projection group 91R, the base part 93, and the void part 92.

In this exemplary embodiment, in each of the left and right projection groups of the upper and lower pressing members, a portion of the projection group is formed of a trapezoidal projection 95. More specifically, each projection group includes the projections 91 and one trapezoidal projection 95.

The trapezoidal projections 95 have a trapezoidal section. The trapezoidal projections 95 project from the surfaces of the base parts 93. The trapezoidal projections 95 have apexes 95A at ends in the projecting direction (i.e., the top-bottom direction in FIG. 8A).

The trapezoidal projections 95 are shorter than the projections 91. More specifically, the distance between the apexes 95A of the trapezoidal projections 95 and the surfaces of the base parts 93 is smaller than the distance, in the top-bottom direction in FIG. 8A, between the apexes 91A of the projections 91 and the surfaces of the base parts 93.

In this exemplary embodiment, the angle θ1 formed between first side surfaces 95B and the second side surfaces 95C of the trapezoidal projections 95 is equal to the angle θ2 formed between first side surfaces and second side surfaces of the other projections (projections 91) in the projection group.

The trapezoidal projection 95 is provided at a longitudinal end of each projection group. In other words, the trapezoidal projections 95 are located next to the void parts 92. More specifically, the trapezoidal projections 95 in the left projection groups 91L are located to the left of the void parts 92 in the longitudinal direction of the pressing member pair 81. The trapezoidal projections 95 in the right projection groups 91R are located to the right of the void parts 92 in the longitudinal direction of the pressing member pair 81.

As shown in FIG. 8B, in this exemplary embodiment, the trapezoidal projections 95 in the projection groups are pressed against a sheet stack B during binding. At this time, as shown by reference sign 8A, the sheet stack B is nipped between the first side surface 95B of the trapezoidal projection 95 of the upper pressing member 83A and the first side surface 95B of the trapezoidal projection 95 of the lower pressing member 83B.

As in this exemplary embodiment, when portions of the projection groups are formed of the trapezoidal projections 95, the sheet stack B are less likely to be creased.

When, for example, as in the configuration shown in FIG. 6B, all the projections in the projection groups are formed of the projections 91 (when there are no trapezoidal projections 95 in the projection groups), the projections 91 deeply enter the opposing pressing member over the entire area of the projection groups in the longitudinal direction.

In this case, the deformation of the pressure-receiving portions of the sheet stack B, against which the projection groups are pressed, is large, and the pressure-receiving portions and the vicinity thereof tend to be creased.

In contrast, as in the configuration shown in FIG. 8B, when some of the projections of the projection groups are the trapezoidal projections 95, the trapezoidal projections 95, which are shorter than the projections 91, do not deeply enter the opposing pressing member.

In this case, the deformation of the portions of the sheet stack B against which the trapezoidal projections 95 are pressed decreases, and these portions and the vicinity thereof are less likely to be creased.

In the sheet stack B, the portions against which the ends of the projection groups are pressed and the vicinity thereof tend to be creased. In this exemplary embodiment, by providing the trapezoidal projection 95 at a longitudinal end of each projection group, the creases formed in the sheet stack B are reduced.

In this exemplary embodiment, the angle θ1 formed between the first side surfaces 95B and the second side surfaces 95C of the trapezoidal projections 95 is equal to the angle θ2 formed between the first side surfaces and the second side surfaces of the projections 91, and the height of the trapezoidal projections 95 is smaller than the height of the projections 91.

This allows the trapezoidal projections 95 to bind the sheet stack B, and thus, the sheet stack B can be more reliably bound.

For example, the creases formed in the sheet stack B may be reduced by reducing the overall size of the projections 91 while preserving the triangular section, thus reducing the height of the projections 91, such as projections 96 illustrated by a dashed line in FIG. 8B.

In this case, a space 8B between the projection 96 of the upper pressing member 83A and the projection 96 of the lower pressing member 83 is larger than the space between the trapezoidal projections 95.

In this case, the pressure applied to the sheet stack B decreases, lowering a force for joining the sheets constituting the sheet stack B together by pressure.

In contrast, as in the trapezoidal projections 95 of in this exemplary embodiment, when the tips of the projections 91 in the projecting direction are removed to make the height of the trapezoidal projections 95 lower than the height of the projections 91, an increase in the space between the trapezoidal projections 95 of the upper pressing member 83A and the trapezoidal projections 95 of the lower pressing member 83B is suppressed.

In this case, the pressure applied to the sheet stack B increases. As a result, the force for joining the sheets constituting the sheet stack B together by pressure increases, and the sheet stack B is more reliably bound.

Third Exemplary Embodiment

Figure 9:
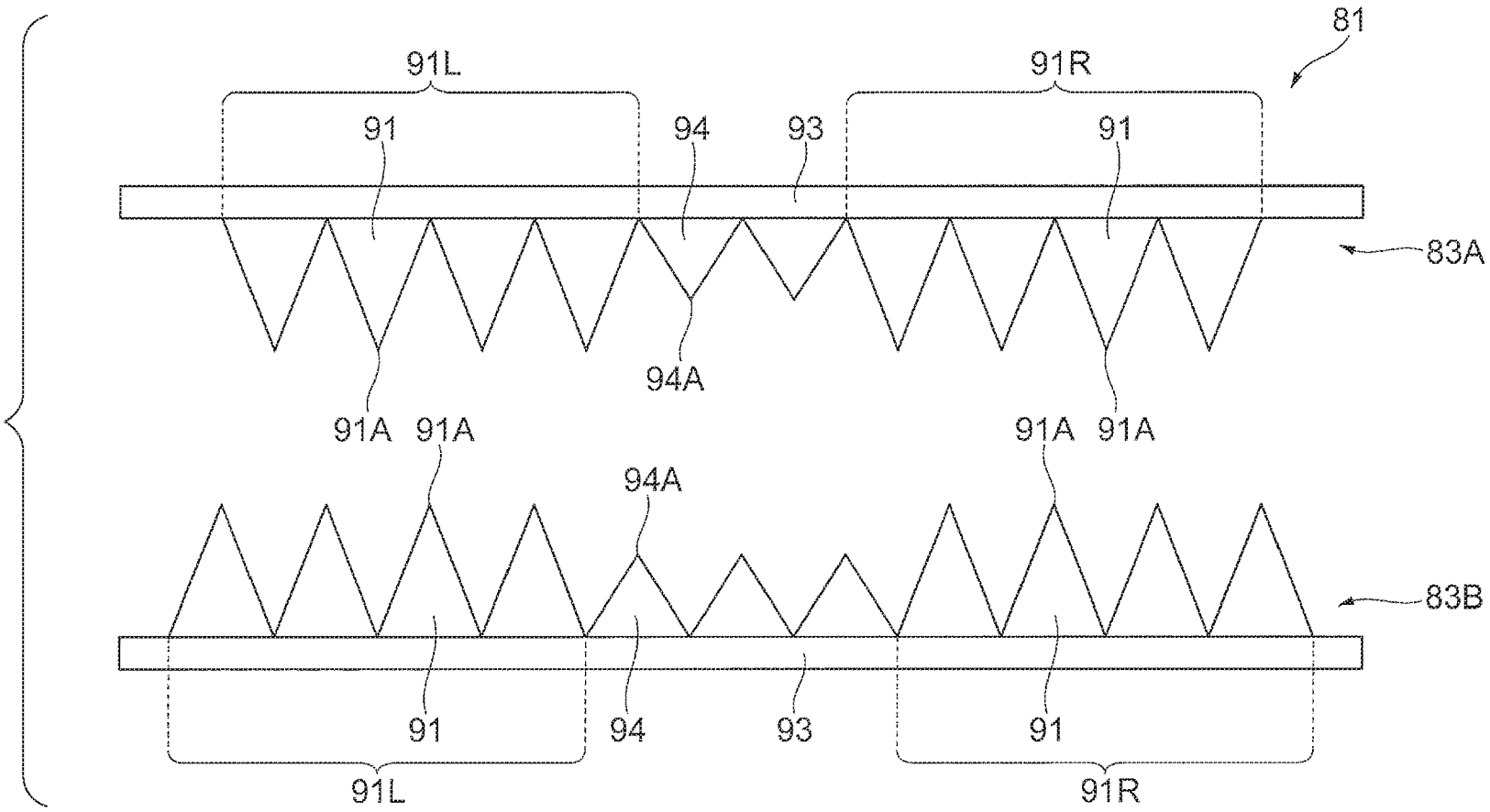
FIG. 9 shows a pressing member pair according to a third exemplary embodiment.

FIG. 9 shows the pressing member pair 81 according to a third exemplary embodiment. The components common to those in the first exemplary embodiment will be denoted by the same reference signs.

As shown in FIG. 9, and as described above, the pressing member pair 81 includes the upper pressing member 83A and the lower pressing member 83B.

The upper pressing member 83A and the lower pressing member 83B each have the left projection group 91L, the right projection group 91R, and the base part 93.

The upper pressing member 83A and the lower pressing member 83B each have multiple lower projections 94 that are arranged side-by-side. The lower projections 94 project from the surfaces of the base parts 93. The lower projections 94 have apexes 94A at ends in the projecting direction (i.e., the top-bottom direction in FIG. 9). The lower projections 94 have a triangular section. The lower projections 94 are provided between the left projection groups 91L and the right projection groups 91R.

The lower projections 94 are shorter than the projections 91. More specifically, the distance between the apexes 94A of the lower projections 94 and the surfaces of the base parts 93 (i.e., the vertical distance in FIG. 9) is smaller than the distance between the apexes 91A of the projections 91 and the surfaces of the base parts 93. In other words, the lower projections 94 project from the base parts 93 by a smaller amount than the projections 91 do. The projections 91 may be regarded as higher projections that project from the base part 93 by a larger amount than the lower projections 94 do. The left and right projection groups may be regarded as high-projection groups in which the higher projections are arranged.

Also in this exemplary embodiment, similarly to the first exemplary embodiment, the elongation of the overall sheet stack B when the pressing members are pressed against the sheet stack B decreases. Hence, the damage to the sheets is less likely to occur, and the sheet binding force is less likely to decrease.

More specifically, because the lower projections 94 are shorter than the projections 91, they do not deeply enter the opposing pressing member, and thus, the elongation of a portion of the sheet stack B against which the lower projections 94 are pressed decreases. As a result, the elongation of the overall sheet stack B decreases, the damage to the sheets is less likely to occur, and the sheet binding force is less likely to decrease. The lower projections 94 may be regarded as suppressing parts that suppress damage to the sheets.

Note that both of the void parts 92 and the lower projections 94 may be provided between the left projection groups 91L and the right projection groups 91R.

Also in that case, the elongation of the opposing part of the sheets in the sheet stack B facing the void parts 92 and the lower projections 94 decreases, and, as a result, the elongation of the overall sheet stack B decreases, the damage to the sheets is less likely to occur, and the sheet binding force is less likely to decrease.

The lower projections 94 do not necessarily have to have a triangular sectional shape, as shown in FIG. 9, and may have a trapezoidal sectional shape, such as that of the trapezoidal projections 95, as shown in FIG. 8.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding apparatus comprising:

a first pressing member configured to press a recording-medium stack from one side of the recording-medium stack;

a second pressing member that faces the first pressing member and is configured to press the recording-medium stack from another side of the recording-medium stack; and a suppressing part provided in at least one of the first pressing member and the second pressing member, wherein the suppressing part is configured to suppress damage to recording media that may be caused when a recording-medium stack including a smaller number of sheets than a maximum number of sheets that can be bound is bound with the first pressing member and the second pressing member, wherein each of the first pressing member and the second pressing member includes a base part, and a plurality of projections projecting from the base part, the projections being configured to press against the recording-medium stack, wherein at least one of the first pressing member and the second pressing member comprises:

a lower projection that projects by a smaller amount from the base part; and a higher projection that projects by a larger amount from the base part than the lower projection, wherein, when a recording-medium stack including a smaller number of sheets than the maximum number of sheets is bound, elongation of a portion of the recording-medium stack against which the lower projection is pressed decreases, lowering tension of a portion of the recording-medium stack against which the higher projection is pressed, thus suppressing damage to the recording media, wherein the one of the first pressing member and the second pressing member includes a plurality of high-projection groups each having a plurality of higher projections arranged side-by-side, and wherein the lower projection is provided between one of the high-projection groups and another of the high-projection groups.

2. The binding apparatus according to claim 1, wherein each of the first pressing member and the second pressing member includes a base part, and a plurality of projections projecting from the base part, the projections being configured to press against the recording-medium stack, wherein at least one of the first pressing member and the second pressing member has a void part in which no projections are provided, and wherein, when a recording-medium stack including a smaller number of sheets than the maximum number of sheets is bound, elongation of a portion of the recording-medium stack facing the void part decreases or is eliminated, lowering tension of a portion of the recording-medium stack against which the projections are pressed, thus suppressing damage to the recording media.

3. The binding apparatus according to claim 2, wherein the one of the first pressing member and the second pressing member includes a plurality of projection groups each having a plurality of the projections arranged side-by-side, and wherein the void part is provided between one of the projection groups and another of the projection groups.

4. The binding apparatus according to claim 2, wherein the at least one of the first pressing member and the second pressing member comprises:

a lower projection that projects by a smaller amount from the base part; and a higher projection that projects by a larger amount from the base part than the lower projection.

5. An image forming system comprising:

an image forming part configured to form an image on a recording medium; and the binding apparatus according to claim 1, wherein the binding apparatus is configured to bind a plurality of recording media having images formed thereon by the image forming part.

6. The binding apparatus according to claim 1, wherein the suppressing part comprises a void part in which no projections are provided.

7. The binding apparatus according to claim 6, wherein the binding apparatus is configured such that no projections are provided between the lower projection and the void part.

8. A binding apparatus comprising:

a first pressing member including a base part, and a plurality of first projections projecting from the base part and having apexes, wherein the first pressing member is configured to press the first projections against one side of a recording-medium stack to press the recording-medium stack; and a second pressing member including a base part, and a plurality of second projections projecting from the base part and having apexes, wherein the second pressing member faces the first pressing member and is configured to press the second projections against another side of the recording-medium stack to press the recording-medium stack, wherein at least one of the first pressing member and the second pressing member comprises at least one of:

a lower projection whose apex is located closer to the base part than apexes of other projections; and a void part in which no projections are provided, wherein the at least one of the first pressing member and the second pressing member comprises the void part, and wherein an apex of a projection located next to the void part, among the plurality of projections provided in the one of the first pressing member and the second pressing member, is located closer to the base part than apexes of other projections included in the plurality of projections.

9. The binding apparatus according to claim 8, wherein the one of the first pressing member and the second pressing member has a plurality of projection groups each having a plurality of projections arranged side-by-side, and wherein the lower projection is provided between one of the projection groups and another of the projection groups.

10. The binding apparatus according to claim 8, wherein an angle formed between a first side surface and a second side surface of the projection located next to the void part is equal to an angle formed between first side surfaces and second side surfaces of other projections.

11. The binding apparatus according to claim 8, wherein the at least one of the first pressing member and the second pressing member comprises both of the lower projection and the void part.

* * * * *